US010502535B2

(12) United States Patent
Sun

(10) Patent No.: US 10,502,535 B2
(45) Date of Patent: Dec. 10, 2019

(54) MODULAR TARGET

(71) Applicant: Ting Sun, Van Alstyne, TX (US)

(72) Inventor: Ting Sun, Van Alstyne, TX (US)

( * ) Notice: Subject to any disclaimer, the term of this patent is extended or adjusted under 35 U.S.C. 154(b) by 0 days.

(21) Appl. No.: 15/595,195

(22) Filed: May 15, 2017

(65) Prior Publication Data

US 2017/0336180 A1 Nov. 23, 2017

Related U.S. Application Data

(60) Provisional application No. 62/338,232, filed on May 18, 2016.

(51) Int. Cl.
*F41J 1/10* (2006.01)
*F41J 7/04* (2006.01)

(52) U.S. Cl.
CPC .. *F41J 7/04* (2013.01); *F41J 1/10* (2013.01)

(58) Field of Classification Search
CPC ..... F41J 1/10
USPC ..... 273/403–408
See application file for complete search history.

(56) References Cited

U.S. PATENT DOCUMENTS 1,542,063 A * 6/1925 Knight ..... A63F 9/0204 124/7
2,809,836 A * 10/1957 Omar ..... F41J 7/04 273/127 R
4,433,843 A * 2/1984 Bricco ..... F41J 1/10 248/165
7,175,181 B1 * 2/2007 Bateman ..... F41J 7/04 273/392
7,325,808 B1 * 2/2008 Adler ..... F41J 1/08 273/406
8,684,361 B2 * 4/2014 Henson ..... F41J 1/01 273/389
9,689,647 B1 * 6/2017 Dolgoff ..... F41J 1/10
9,714,816 B2 * 7/2017 Temple ..... F41J 1/10
9,829,285 B1 * 11/2017 Kimblad ..... F41J 1/10
2012/0175844 A1 * 7/2012 Potterfield ..... F41J 1/10 273/406
2014/0252719 A1 * 9/2014 Johnson ..... F41J 1/10 273/407
2015/0276356 A1 * 10/2015 Cesternino ..... F41J 1/10 273/370
2015/0292842 A1 * 10/2015 Pixton ..... F41J 1/10 273/407
2016/0265885 A1 * 9/2016 Logan ..... F41J 9/00

* cited by examiner

*Primary Examiner* — Mark S Graham
(74) *Attorney, Agent, or Firm* — Bobby W. Braxton; Braxton Perrone, PLLC

(57) ABSTRACT

A system and method for a modular target. The modular target system has a target coupled to at least one target support. The target support is coupled to a base. The target support has notches on the upper distal end. The modular target system has separate components which can be assembled and disassembled without coupling devices such as bolts, screws, etc. This allows the modular target to be stored in more compact locations and configurations.

10 Claims, 4 Drawing Sheets

MODULAR TARGET

PRIORITY

The present invention claims priority to U.S. Provisional Application No. 62/338,232 filed May 18, 2016, the entirety of which is hereby incorporated by reference.

BACKGROUND OF THE INVENTION

Technical Field

The present invention relates to a system and method for a modular target.

Description of Related Art

Shooting targets allow for users to practice and hone their shooting skills. However, many targets require significant installation which often includes nuts, bolts, screws, welding, etc. Consequently, there is a desire for a modular target which assembles similar to a puzzle.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1:
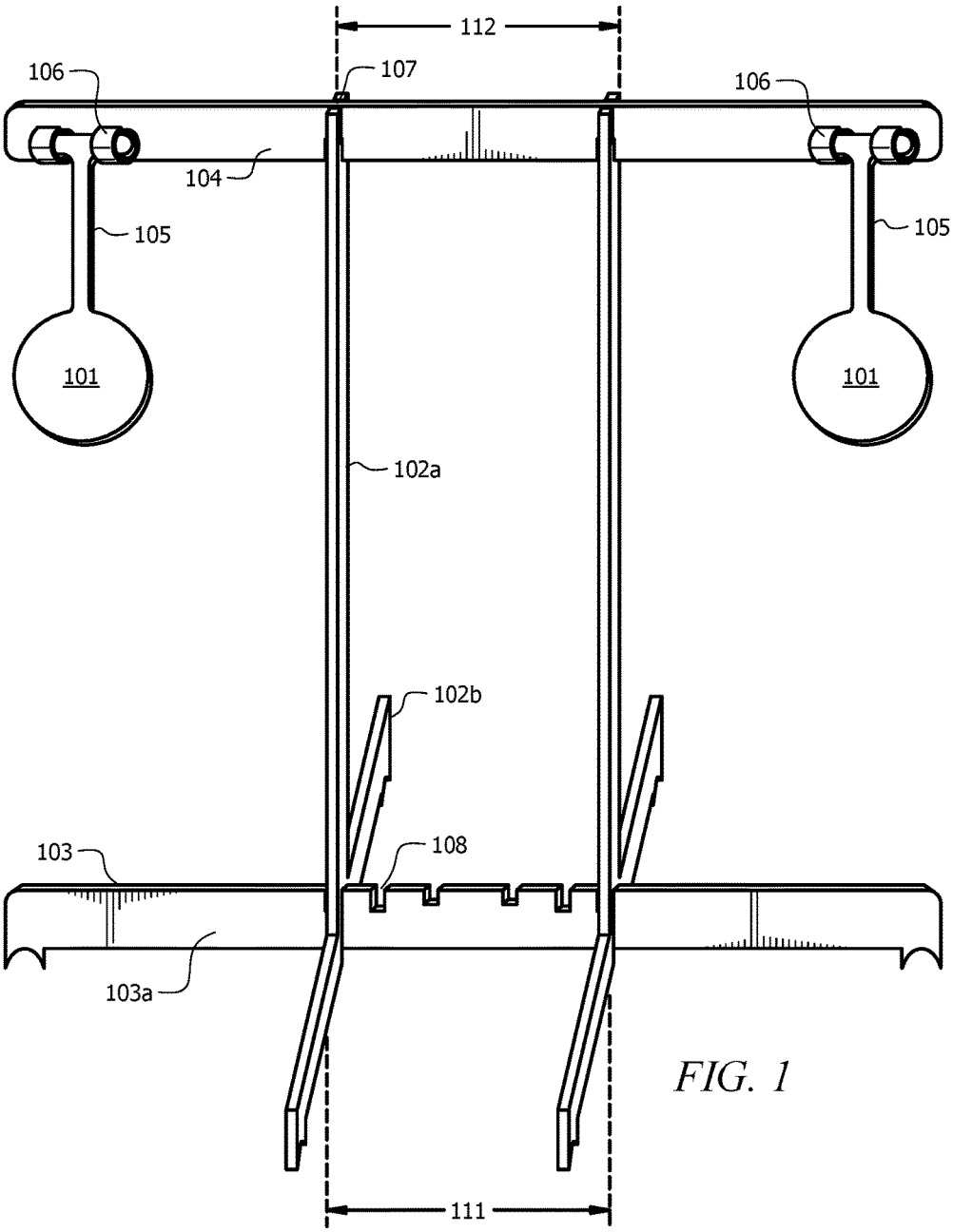
FIG. 1 is a perspective view of an assembled target in one embodiment.

FIG. 1 is a perspective view of an assembled target in one embodiment. The assembly, in one embodiment, comprises several modular components. As used herein, modular refers to components which can be assembled and disassembled in separate pieces. In one embodiment modular refers to components which can be assembled and disassembled without the use of external tools or coupling devices. A coupling device refers to screws, bolts, nails, and other common tools commonly used to couple two items together. In one embodiment the modular system can be assembled and disassembled like a puzzle, without the use of coupling devices.

In one embodiment the assembly comprises the following components: at least one target 101, a base 103, and a target support 102. As used herein, a target refers to an item which is placed down range and which a shooter is attempting to hit. The target can comprise a firearm target which is used by firearms, including pistols, handguns, rifles, shotguns, etc. The target can also comprise a non-firearm target and include a target for archery, cross-bow, etc.

In one embodiment the target comprises a re-usable target. A re-usable target, as used herein, refers to a target which can be reused several times before being replaced. This is contrasted with a paper target, for example, which must be replaced frequently. A re-usable target provides some visual indicia of contact but need not be replaced like a paper target.

The assembly in FIG. 1 comprises two targets 101 which each comprise a T-shaped handle 105. The T-shaped handle 105 is coupled to the target portion of the target 101. The target portion is the portion which the shooter is attempting to shoot. As depicted, the target portion is circular. This is for illustrative purposes only and should not be deemed limiting. As used herein the term couple refers to direct coupling and/or indirect coupling.

In one embodiment the target 101 comprises a single, integrally made, piece. Thus, the T-shaped portion is integrally connected with the target portion. In other embodiments, however, the T-shaped portion is coupled to the target portion via any connecting method known in the art including, but not limited to, welding, soldering, nuts, bolts, etc. In one embodiment, the user receives the target 101 as a single unit. Put differently, in one embodiment, the user does not have to assemble the target 101.

As depicted, the two targets 101 are suspended and coupled to a target cross-member 104. As depicted, the target cross-member 104 is approximately perpendicular to the target support 102. The cross-member 104 is coupled to the support 102 via any method known in the art. As depicted, the cross-member 104 comprises notches 107 which mate with the support member 102. Thus, in one embodiment, the cross-member 104 simply rests upon the support member 102. The coupling and de-coupling of the cross-member 104 with the support member 102, in one embodiment, comprises no external tools, screws, or other components. Rather, the two items simply mate to couple and de-couple.

In one embodiment, and as depicted, the assembly comprises two support members 102. Having two or more support members 102 provides additional support for the assembly. Two or more support members 102 allows the target system to absorb the energy of a projectile, flex as required, and reassume the desired upright and assembled position.

In one embodiment, and as depicted, the separation between the two support members 102 at their lower distal end is greater than the distance between the two support members 102 at their upper distal end. The lower end distance 111 refers to the distance between support members 102 as measured at the lower distal end. In one embodiment the lower distal end is the intersection of the support members 102 and the base 103. The lower end distance can vary depending upon the size of the target. In one embodiment the lower end distance ranges from about 6 inches to about 20 inches. In one embodiment the lower end distance is about 10 inches.

Figure 3:
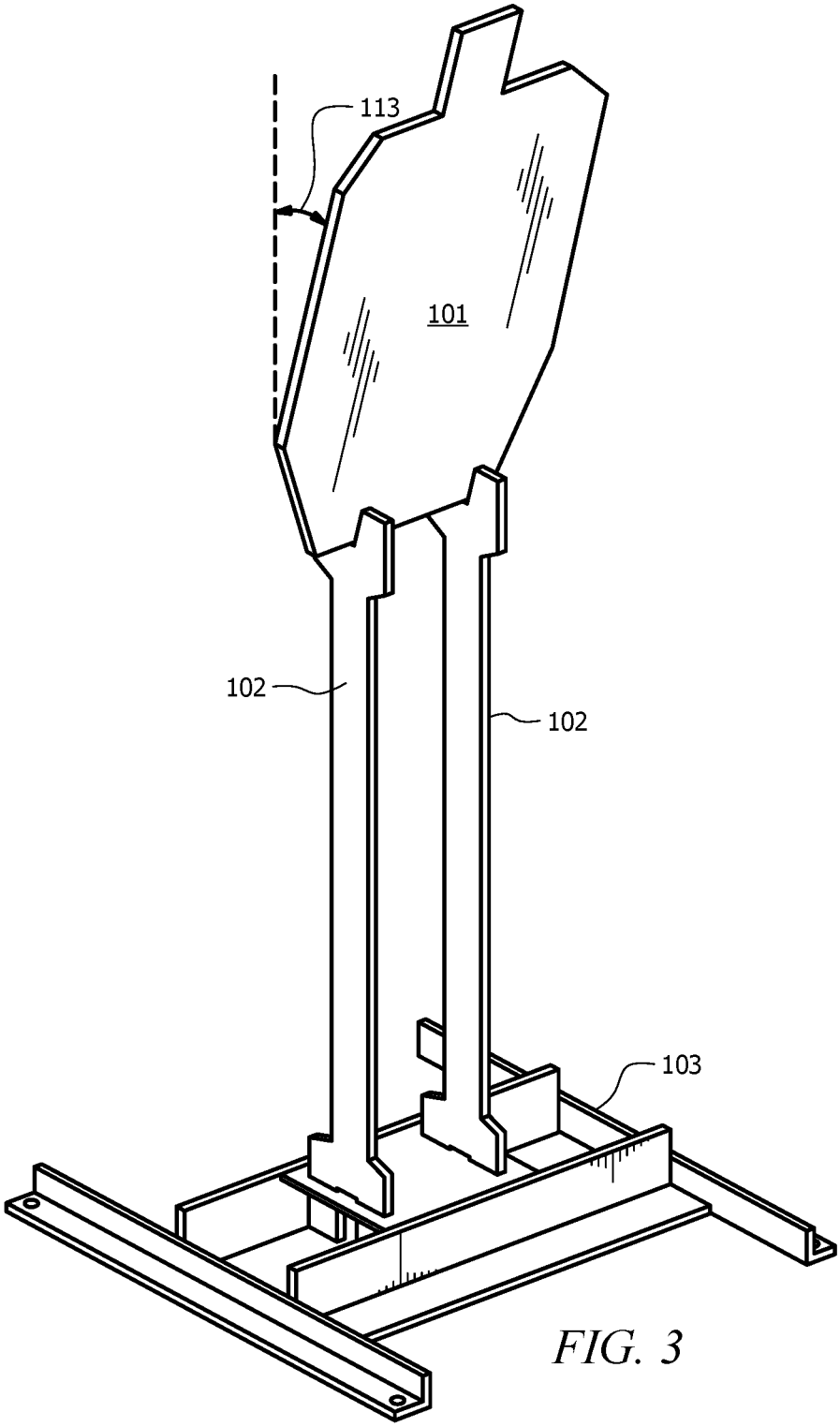
FIG. 3 is a perspective view of an assembled target in one embodiment.

The upper end distance 112 refers to the distance between support members 102 as measured at the upper distal end. The upper end distance refers to the distance between support members 102 as measured at the upper distal end. In one embodiment the upper distal end is the intersection of the support members 102 with either the target 101 (as shown in FIG. 3) or the target cross-member 104 (as shown in FIG. 1). In one embodiment the upper end distance ranges from about 4 inches to about 15 inches. In one embodiment the upper end distance is about 6 inches. In one embodiment the upper end distance is 6 inches and the lower end distance is about 10 inches. In one embodiment the upper end distance is between about 40-80% of the lower end distance.

In one embodiment the lower end distance 111 is greater than the upper end distance 112. In one embodiment the lower end distance 111 is greater than the upper end distance 112 by more than 10%. Embodiments with a lower end distance 111 greater than the upper end distance 112 provides several benefits. First, such an arrangement offers increased structural support. Squeezing the upper distal ends of the supports 102 provides resistance and structural resiliency. Such an arrangement provides a force to keep the target system upright and in its desired assembled orientation without the need for coupling devices. Second, such an arrangement also allows the assembly to better absorb the impact of a projectile.

While one embodiment comprising two or more support members 102 is provided, this is for illustrative purposes only and should not be deemed limiting. In one embodiment a single support member 102 is utilized. In one embodiment the base 103, described in more detail below, comprises two or more components which intersect. In one embodiment the single support member 102 couples to the base in at least two positions. In one embodiment the single support member 102 couples to each of the intersecting components of the base 103.

As noted, in the embodiment depicted in FIG. 1, the targets 101 are coupled to the cross-member 104. In one embodiment the targets 101 are removably coupled to the cross-member 104. In one embodiment the targets 101 are coupled without requiring external tools, screws, or other components.

As depicted the cross-member 104 comprises target mounts 106 which allows the targets to be coupled to the cross-member 104. As depicted, the mounts 106 are hollow members, such as, for example, tubes or pipes, which each comprise one open slot. The open slot allows the T-shaped handle 105 to be received by the mount 106. In one embodiment, the internal diameter of the mounts 106 are greater than the width of the top portion of the T-shaped handle 105. Such an arrangement allows the top portion of the T-shaped handle 105 to be completely received by the mount 106. Further, such an arrangement allows the target 101 to move in the up and down range direction (forwards and backwards as depicted in FIG. 1). As used herein, down range refers to a location relative to a shooter. A position closer to a shooter is referred to herein as up range, whereas a position further from the shooter is referred to as down range. Consequently, in one embodiment when the target is hit with a projectile, such as a bullet, the target 101 is allowed to move, or rotate, in the up and down range direction. This provides the shooter with visual indicia that the target has been successfully hit.

As can be seen, when the target portion 101 is hit, the target portion will be forced down range by the force of the projectile. However, because the T-shaped portion 105 is coupled to the mount 106, the force of the projectile will cause the target 101 to rotate about the T-shaped portion 105. The forces of the projectile can be absorbed by the assembly. If the left target is hit, for example, the left side of the assembly will flex in the down range direction until it is counteracted by the remainder of the assembly. Thereafter, the assembly will re-attain its pre-impact configuration.

Also coupled to the target support 102 is the base 103. In one embodiment the base 103 is oriented approximately perpendicular to the target support 102 and parallel to the cross-member 104.

The base 103 can be coupled to the support 102 via any coupling methods or devices known in the art. In one embodiment the base 103 comprises notches which couples with the support 102. While one embodiment has been described wherein the base 103 has notches, this is for illustrative purposes only and should not be deemed limiting. In other embodiments, for example, the support 102 comprises notches. In one embodiment both the support member 102 and the base 103 comprise notches which mate together when coupled.

As depicted, the support 102 comprises a T-shape. As depicted, the support 102 comprises two components: a main component 102*a* and a legs component 102*b*. In one embodiment the legs component 102*b* is approximately perpendicular to the main component 102*a*. In one embodiment the legs component 102*b* are oriented to run parallel to the direction of down range, i.e., the direction the projectile travels. Such an orientation allows the impact of the projectile to be absorbed and counteracted by the legs component 102. In one embodiment the main component 102*a* and the leg component 102*b* are integrally made whereas in other embodiments the two are coupled via welding, soldering, or the like.

The components of the assembly can comprise virtually any material, including but not limited to, metal, plastic, rubber, etc. In one embodiments the target 101 comprises metal. Such an embodiment allows for both a visual indicia as well as an audio indicia that impact with the target has been successfully achieved.

As noted, in one embodiment the components of the assembly are modular and require no tools to assemble. In one embodiment the components require no bolts, screws, welding, etc. Rather, the components fit together like a puzzle. In one embodiment the base is first positioned in the desired location. Thereafter the support 102 is coupled to the base 103 via the notches. The cross-member 104 is then coupled to the support 102 via the notches. Finally, the targets 101 are coupled to the mount 106 via the slots in the mounts 106. Thus, the entire assembly is assembled with no external parts or tools. The assembly can be disassembled by reversing the steps described above.

Figure 2:
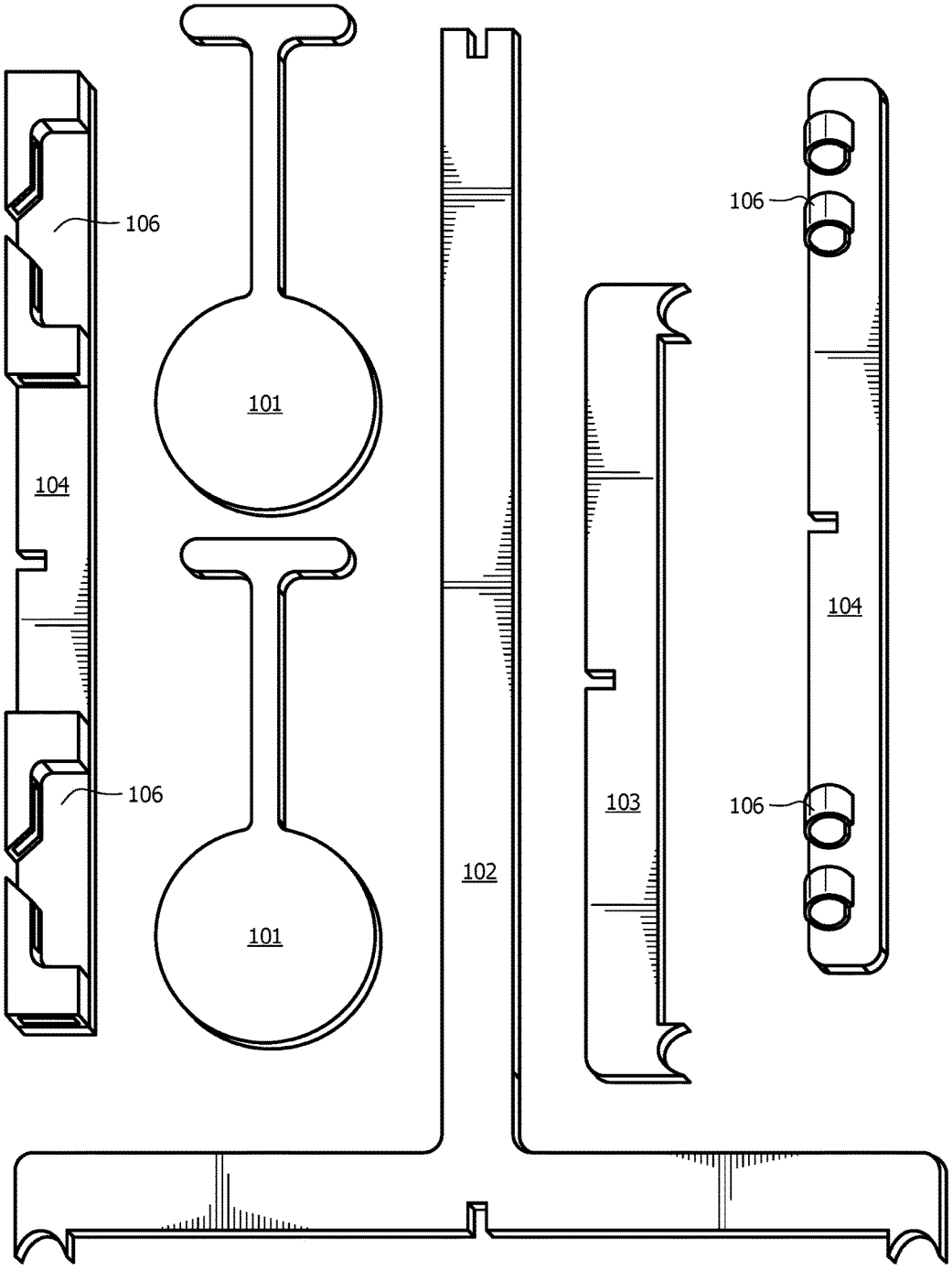
FIG. 2 is a perspective view of an the an assembly in a disassembled form in one embodiment.

FIG. 2 is a perspective view of an assembly in a disassembled form. As depicted is a single support 102, a base 103, a cross member 104, and targets 101. In the target depicted, there is a single support 102 as opposed to the double supports 102 depicted in FIG. 1. Also, FIG. 2 depicts another embodiment of the cross-member 104. The cross-member 104 on the left of FIG. 2 depicts a variant of the mount 106 discussed above. Rather than having a hollow tube or pipe, the cross-member 104 comprises recesses which receive the top portion of the T-shaped handle 105 of the target 101.

FIG. 3 is a perspective view of an assembled target in one embodiment. As depicted, the assembly does not comprise a cross-member. Instead, the target 101 couples directly to the support 102 at two separate locations via notches located at an upper distal end of the support 102.

As depicted, the target 101 comprises the shape of a human torso. This is for illustrative purposes and should not be deemed limiting. Virtually any shape can be used for the target 101.

FIG. 3 shows a target which comprises a downward reflective angle 113. A downward reflective angle 113 is an angle which will is angled relative to the normal. A downward reflective angle 113, in one embodiment, is angled such that projectiles are reflected in a downward direction. This is a safety feature as it sends the projectile, such as a bullet, downward into a desired location. The angle can vary, but in some embodiments, the angle ranges from about 10 to about 30 degrees. In one embodiment the angle is about 19 or about 20 degrees.

Figure 4:
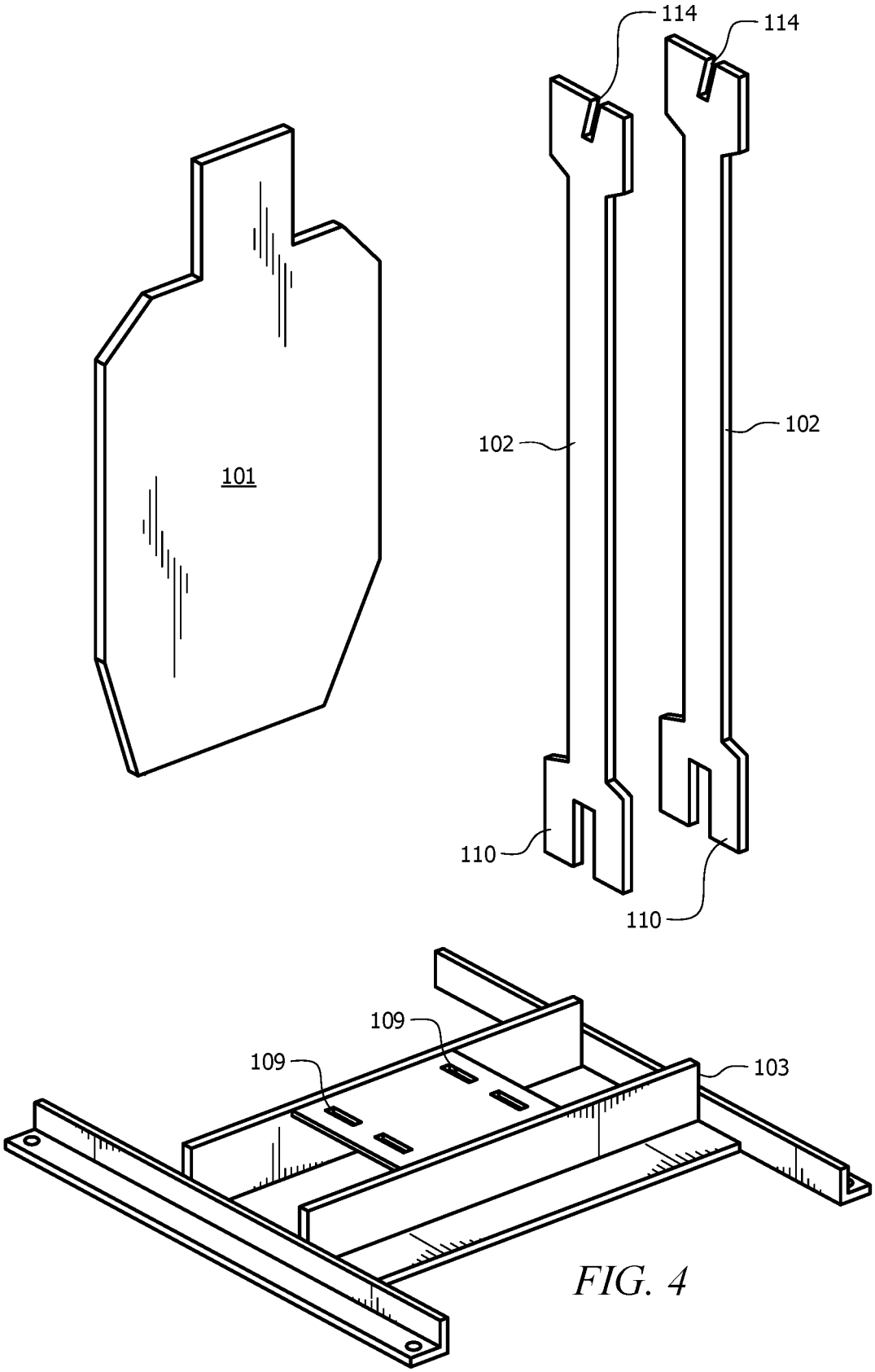
FIG. 4 is a figure of the components from the target in FIG. 3 in one embodiment.

FIG. 4 is a figure of the components from the target in FIG. 3 in one embodiment. As can be seen, the support 102 comprises notches 110 at each distal end. The notches allow the support 102 to couple to the target 101 and the base 103. In one embodiment the presence of a notch produces two fork prongs at the distal end of the support 102.

As depicted, the base 103 comprises notch holes 109 which receive the forks of the support 102. This allows the support 102 to be coupled to the base 103. As above, this coupling is for illustrative purposes only and should not be deemed limiting.

As can be seen, to assemble the assembly depicted in FIG. 3, the forks are inserted into the holes 109 of the base 103. Thereafter, the support 102 is coupled to the target 101. As with the assembly of FIG. 1, no external parts or tools is required to assemble or disassemble the assembly of FIGS. 3 and 4.

Returning back to FIG. 3, if the target 101 is hit with a projectile, such as a bullet, on the upper left shoulder, the upper left shoulder will flex down range upon impact. The supports 102 will flex in reaction to the impact. For example, the right support 102 will travel up range. The two supports 102 will eventually absorb the force of the impact and re-attain the pre-impact orientation. Thereafter, the shooter can again take aim and fire upon the target 101. The flexing and moving of the target 101 provides the shooter with visual indicia that the target has been successfully hit.

The target assembly discussed has several benefits. First, as discussed, it is modular and accordingly results in increased customization. The target 101, for example, if it becomes damaged, can simply be replaced. Further, the target 101 can be replaced or exchanged for a shooter's preferred look or style. As an example, the target portion can be round, can comprise a bullseye or not, etc. The shooter can also replace or exchange other components based on color, material, height, size shape, etc. As but one example, a larger target 101 can be replaced with a smaller target 101 to increase the difficulty of the shoot. Thus, the target is fully customizable.

Second, because the assembly is modular, an additional benefit is portability. The target need not be carried in it assembled orientation. Often, a truck would be required to transport or move a large target assembly. Because the assembly can be disassembled with no additional tools or parts, even large targets can be stored and hauled in a vehicle's trunk. This increases portability of the assembly.

A third benefit is ease of installation. As noted, many targets require welding, bolts, screws, etc. to assemble the targets. If these tools are not available, then the target cannot be assembled or disassembled. However, by not requiring tools or external parts, the ease of assembly is increased. Accordingly, the target can be safely, effectively, and efficiently removed and disassembled. This reduces time that the user stays down range. Further, this increases the amount of time that the user can practice target shooting as opposed to carrying, assembling, and disassembling the target.

While the invention has been particularly shown and described with reference to a preferred embodiment, it will be understood by those skilled in the art that various changes in form and detail may be made therein without departing from the spirit and scope of the invention.

ADDITIONAL DESCRIPTION

The following clauses are offered as further description of the disclosed invention.

Clause 1. A modular target system, said system comprising:
a target coupled to at least one target support;
wherein said target support is coupled to a base; and
wherein said target support comprises notches on an upper distal end.

Clause 2. The modular target system of any proceeding or preceding clause comprising two target supports, wherein said target supports are approximately perpendicular to said base.

Clause 3. The modular target system of any proceeding or preceding clause wherein said target supports are separated at a lower end by a lower end distance, and wherein said targets are separated at an upper end by an upper end distance, and wherein said lower end distance is greater than said upper end distance, and wherein said lower end is located at a lower distal end, and wherein said upper end is located on an upper distal end, and wherein said lower end is located at the intersection of said target supports and said base.

Clause 4. The modular target system of any proceeding or preceding clause wherein said upper end is located at the intersection of said target supports and said target.

Clause 5. The modular target system of any proceeding or preceding clause wherein said upper end is located at the intersection of said target supports and a target cross-member, wherein said target is coupled to a target cross-member, and wherein said target cross-member is coupled to said target support, and wherein said target cross-member is approximately perpendicular to said target support.

Clause 6. The modular target system of any proceeding or preceding clause wherein said target cross-member comprises notches for engaging with said target support.

Clause 7. The modular target system of any proceeding or preceding clause wherein said target cross-member comprises at least one mount, wherein said at least one mount comprises a hollow member with a slot for receiving a target.

Clause 8. The modular target system of any proceeding or preceding clause wherein said cross-member comprises at least two mounts, wherein said at least two mounts comprise a hollow tube, each with a slot for receiving an upper portion of a T-shaped handle attached to a target, wherein said mount is sized to allow said target to move up range and downrange when the target is struck with a projectile.

Clause 9. The modular target system of any proceeding or preceding clause wherein said base comprises notches for engaging with said target support.

Clause 10. The modular target system of any proceeding or preceding clause wherein said target support comprises legs at its lower distal end.

Clause 11. The modular target system of any proceeding or preceding clause wherein said system does not comprise any bolts, screws, or nails.

Clause 12. The modular target system of any proceeding or preceding clause which can be assembled and disassembled without the use of any external tools or coupling devices.

Clause 13. The modular target system of any proceeding or preceding clause wherein said notches on said target support comprise angled notches so that said target comprises a downward reflective angle.

I claim:

1. A modular target system, said system comprising:

a target coupled to at least two target supports separated by a distance;

wherein said target supports are coupled to a base, wherein said base comprises notches on an upper end for engaging with said target supports;

wherein said target supports comprise notches on an upper distal end, wherein said target supports are approximately perpendicular to said base;

wherein said two target supports and said base are modular; and wherein said target supports are separated at a lower end by a lower end distance, and wherein said target supports are separated at an upper end by an upper end distance, and wherein said lower end distance is greater than said upper end distance, and wherein said lower end is located at a lower distal end, and wherein said upper end is located on an upper distal end, and wherein said lower end is located at the intersection of said target supports and said base;

wherein said target supports each comprise a main component and a leg component, wherein each of said leg component is approximately perpendicular to the main component; and wherein said target supports comprise a T-shape, with each leg component extending from a middle of said main component.

2. The modular target system of claim 1 wherein said upper end is located at the intersection of said target supports and a target cross-member, wherein said target is coupled to a target cross-member, and wherein said target cross-member is coupled to each of said target supports, and wherein said target cross-member is approximately perpendicular to each of said target supports.

3. The modular target system of claim 2 wherein said target cross-member comprises notches for engaging with said target supports.

4. The modular target system of claim 2 wherein said target cross-member comprises at least one mount, wherein said at least one mount comprises a hollow member with a slot for receiving a target.

5. The modular target system of claim 4 wherein said cross-member comprises at least two mounts, wherein said at least two mounts comprise a hollow tube, each with a slot for receiving an upper portion of a T-shaped handle attached to a target, wherein said mount is sized to allow said target to move up range and downrange when the target is struck with a projectile.

6. The modular target system of claim 1 wherein said system does not comprise any bolts, screws, or nails.

7. The modular target system of claim 1 which can be assembled and disassembled without the use of any external tools or coupling devices.

8. The modular target system of claim 1 wherein the upper end distance is between about 40-80% of the lower end distance.

9. The modular target system of claim 1 wherein said target is directly coupled said at least two target supports.

10. The system of claim 1 wherein said target comprises a metal target.

* * * * *